US007005013B2

(12) United States Patent
Hammock

(10) Patent No.: US 7,005,013 B2
(45) Date of Patent: Feb. 28, 2006

(54) SURFACTANT-FREE CLEANING COMPOSITIONS AND PROCESSES FOR THE USE THEREOF

(75) Inventor: Cory S. Hammock, Macon, GA (US)

(73) Assignee: Clean Control Corporation, Warner Robins, GA (US)

( * ) Notice: Subject to any disclaimer, the term of this patent is extended or adjusted under 35 U.S.C. 154(b) by 11 days.

(21) Appl. No.: 11/011,512

(22) Filed: Dec. 14, 2004

(65) Prior Publication Data

US 2005/0096241 A1 May 5, 2005

Related U.S. Application Data

(62) Division of application No. 10/078,010, filed on Feb. 19, 2002, now Pat. No. 6,835,704.

(60) Provisional application No. 60/322,308, filed on Sep. 14, 2001.

(51) Int. Cl.
*B08B 7/00* (2006.01)

(52) U.S. Cl. ..... 134/40; 134/42; 510/108; 510/278; 510/280; 510/291; 510/384; 510/405; 510/434; 510/435

(58) Field of Classification Search ..... 134/40, 134/42; 510/108, 278, 280, 291, 405, 434, 510/435; 252/384; 519/384, 405
See application file for complete search history.

(56) References Cited

U.S. PATENT DOCUMENTS 4,035,148 A * 7/1977 Metzger et al. ..... 8/137
4,203,859 A 5/1980 Kirn et al.
4,925,588 A * 5/1990 Berrod et al. ..... 510/299
5,510,047 A 4/1996 Gabriel et al.
5,514,302 A * 5/1996 Brown ..... 510/280
5,527,486 A * 6/1996 De Guertechin ..... 510/365
5,565,145 A 10/1996 Watson et al.
5,566,145 A 10/1996 Sasaki
5,643,861 A 7/1997 de Guertechin et al.
5,679,631 A * 10/1997 Bohnert et al. ..... 510/411
5,781,729 A 7/1998 Baker et al.
5,904,735 A 5/1999 Gutierrez et al.
5,905,065 A 5/1999 Scialla et al.
5,928,384 A 7/1999 Scialla et al.
5,929,007 A * 7/1999 Feng ..... 510/197
5,962,391 A * 10/1999 Oldenhove ..... 510/369
6,019,963 A 2/2000 Kling et al.
6,171,346 B1 1/2001 Yeazell et al.
6,177,395 B1 1/2001 Silvaggi et al.
6,274,540 B1 8/2001 Scheibel et al.
6,316,399 B1 11/2001 Melikyan et al.
6,326,344 B1 12/2001 Levitt
6,403,547 B1 6/2002 Grippaudo et al.
6,407,048 B1 6/2002 Grippaudo et al.
6,605,579 B1 * 8/2003 Arvanitidou et al. ..... 510/235
6,835,704 B1 * 12/2004 Hammock ..... 510/278
2003/0215470 A1 11/2003 Wilmott et al.

OTHER PUBLICATIONS

J.C.T. Kwak, Editor: *Polymer-Surfactant Systems*; Marcel Dekker, New York (1998).
E.D. Goddard and K.P. Anathapadhmanabhan, Editors; *Interactions of Surfactants with Polymers and Proteins*; CRC PRess; Boca Raton, FL (1993).
J. Gauthire-Lafaye and T. Gresser; *Polymers in Detergency,*; AOCS 4th World Congress on Dewtergents, Rhodia, Courbevoie, France (1998).
R. Nagarajan, *Polymer-Surfactant Interactions*; AOCS Presentation, Pennsylvania state University (2001).
Mandeep Singh Bakshi; *Surfactant-Polymer Interactions*; Journal of Surfactants and detergents, vol. 4, No. 1; (Jan. 2001).
Donald H. Napper; *Polymer Stabilation of Colloidal Dispersions*; Colloid Science. (1983).

* cited by examiner

*Primary Examiner*—M. Kornakov
(74) *Attorney, Agent, or Firm*—Troutman Sanders LLP

(57) ABSTRACT

Surfactant-free cleaning compositions are provided for use in removing soil and stains from fiber surfaces such as carpets, upholstery and the like as well as for preventing redeposition of soil and stains on such surfaces. Additionally, processes are provided for cleaning such soiled and/or stained fiber surfaces utilizing aqueous forms of such surfactant-free cleaning compositions having a surface tension of greater than about 38 dynes per centimeter.

17 Claims, No Drawings

SURFACTANT-FREE CLEANING COMPOSITIONS AND PROCESSES FOR THE USE THEREOF

CROSS REFERENCE TO RELATED APPLICATION

This application is a Divisional application of U.S. patent application Ser. No. 10/078,010, filed Feb. 19, 2002, now U.S. Pat. No. 6,835,704 which is incorporated herein by reference and which claims the benefit of U.S. Provisional Patent Application Ser. No. 60/322,308, filed Sep. 14, 2001.

BACKGROUND OF THE INVENTION

1. Field of the Invention

The present invention relates to the field of cleaning compositions and to processes for utilizing such compositions to clean carpets, upholstery and other fiber surfaces. More particularly, the present invention is directed to surfactant-free cleaning compositions for use in removing soil and stains from carpets, upholstery and the like as well as for preventing redeposition of soil and stains on such surfaces and to processes for cleaning such soiled and/or stained surfaces utilizing surfactant-free cleaning compositions.

2. Description of Related Art

Commercial carpets, upholstery and other fiber surfaces are routinely treated with soil repellant finishes that form low energy hydrophobic barriers intended to prevent staining caused by various household soils. In this regard, common household soils may be either hydrophilic or hydrophobic in nature and generally have an intrinsic surface energy above that of normal carpet and upholstery soil repellant finishes.

Heretofore, it has been common practice to supply cleaning compositions for treatment of carpets, upholstery and such fiber surfaces in the form of solutions containing micelle-forming surfactants and polymer-micelle-forming surfactant complexes therein. The use of these micelle-forming surfactant ingredients have been demonstrated to provide certain advantageous properties to cleaning composition in terms of emulsification and dispersion of soils. However, the micelle-forming surfactants also have been found to exhibit certain disadvantageous properties which tend to outweigh their generally recognized benefits.

Specifically, the micelle-forming surfactants which have been utilized in prior art cleaning compositions have functioned to reduce the water/oil interfacial tension at the surface of the fiber substrate for purposes of encapsulating oil particles for removal in much the same manner as is typical for most consumer cleaning products such as hard surface cleaners, fabric cleaners, personal care products and the like. This lowering of the surface tension (i.e., the force per unit length on the surface that opposes the expansion of the surface area) when prior art aqueous cleaning solutions has been utilized have been found to be counterproductive in practice resulting in the cleaning solution causing many soils and/or stains to penetrate into and "wet" the fiber surface, thereby, to cause the soiled section or stain in the fiber surface to spread over a larger area rather than to be removed. Additionally, this "wetting" tends to cause fibers to untwist, particularly under mechanical force, thereby causing increased fiber damage and wear.

Thus, it has been recognized previously that cleaning compositions are needed to apply to a soiled area or stain in a fiber surface that will not "wet" the fiber when applied and will provide adequate soil suspending properties in order to solve the problems which have been encountered with the prior art surfactant containing cleaning compositions.

SUMMARY OF THE INVENTION

It is an object of the present invention to overcome the problems which have been encountered with prior art surfactant containing cleaning compositions and, particularly, the above-noted wetting and soil spreading problems which have been encountered employing previous cleaning compositions containing micelle forming surfactants.

It is another object of the present invention to provide surfactant-free cleaning compositions for use in removing soils and stains from fiber surfaces such as carpets and upholstery, as well as a variety of other fiber surfaces, particularly stain resistant surfaces.

Another object of the present invention is to provide processes for cleaning fiber surfaces, particularly, stain resistant carpet and upholstery surfaces, utilizing a surfactant-free cleaning composition.

A further object is to provide processes for treating carpets and upholstery having soil repellant and/or stain resistant finishes applied thereto with surfactant-free cleaning compositions to enhance the removal of stains and soil from the carpets and upholstery and to prevent subsequent redeposition of soil thereon without interfering with the operation of the soil repellant and/or stain resistant finishes. In this regard, it is a particular object of the present invention to provide surfactant-free cleaning compositions which promote higher surface tension characteristics than prior art cleaning compositions when applied to fiber surfaces treated with standard soil repellant and stain resistant finishes so that the resistant finishes are able to perform effectively in providing soil and stain repellant/resistant properties by keeping any soil and/or stains contained on the surface of the fiber and available for subsequent removal by absorption or extraction.

These and other objects will become apparent hereinafter to those skilled in the art.

DETAILED DESCRIPTION OF A PREFERRED EMBODIMENT OF THE INVENTION

It has been found that the above-noted objectives can be accomplished by providing surfactant-free, aqueous cleaning compositions including a polymeric dispersing agent, at least one alkali counter ion and a polymeric anti-redeposition agent. The compositions may optionally further include ingredients such as chelating agents, fragrance materials, fragrance solubilizing agents and preservative agents.

Exemplary of suitable polymeric dispersing agents for use in the compositions of the present invention are water-soluble polymeric and co-polymeric compounds such as polyacrylic acid; polyacrylic acid/maleic acid copolymers; polymethacrylic acid, polyaspartic acid and the like.

Exemplary of suitable polymeric anti-redeposition agents for use in the compositions of the present invention are water-soluble polymeric and co-polymeric compounds such as polyvinylpyrrolidone; polyvinylbetaine; polyvinyl pyrrolidone/vinylacetate copolymers; polyvinylpyrrolidone/dimethylaminoethylmethacrylate copolymers; polyvinylpyrrolidone/acrylic acid copolymers; polymethylvinylether/maleic anhydride copolymers; polyvinylpyridine-n-oxide and the like which form complexes with anionic and cationic substrates and, to a lesser degree, with nonionic substrates such as household soils, dirt, stains and the like.

Suitable alkali counter ions for use in the compositions of the present invention include sodium ions, potassium ions, calcium ions, magnesium ions, ammonium and amine ions (for example, from ammonium hydroxide, isopropylamines, and alkanolamines), and the like.

With regard to the optional ingredients for inclusion in the cleaning compositions of this invention, suitable chelating agents include water soluble compounds such as ethylenediaminetetraacetic acid; diethylenediaminepentaacetic acid; nitrilotriacetic acid; hydroxyethylenediaminetriacetic acid; iminodisuccinate acid; aminotrismethylenephosphonic acid; hexamethylenediaminetetramethylenephosphonic acid; diethylenetriaminepentamethylene-phosphonic acid and the like.

Concerning suitable fragrance materials for use in the surfactant-free cleaning compositions of the present invention, it should be noted that any desirable known scenting or fragrance types may be employed to produce such compositions provided that the fragrance or scent passes standard screening for challenge testing and storage stability and, furthermore, that users/customers would be satisfied with the aesthetics (i.e., color, smell and the like) of cleaning composition containing the fragrance. Examples of suitable fragrance materials for use herein include, but are not limited to, terpene compounds such as monocyclic terpenes such as limonene; dicyclic terpenes such as pinene; and acyclic terpenes such as myrcene and the like. Also, oxygenated terpene derivatives such as alcohols, aldehydes, esters, ethers, ketones and the like; as well as oxygenated aromatic derivatives such as alcohols, aldehydes, esters, ethers, ketones and the like may be employed as the fragrance material in the present compositions.

Exemplary of preferred terpene compounds for use herein are oils derived from citrus peels such as lemons, oranges, limes, tangerines, grapefruits and the like. Such oils are comprised of about 70–90% (by weight) terpenes (limonene, pinene, and myrcene) with smaller amounts of alcohols (terpineol, linalool, geraniol, octanol, and nonanol) and aldehydes (citral and citronellal). Examples of an oxygenated terpene derivative suitable for use as a fragrance in the compositions of this invention are oils of *eucalyptus globulus,* which are comprised of about 80% (by weight) terpene ether (cineol) with smaller amounts of other terpene compounds. An example of an oxygenated aromatic derivative would be oil of wintergreen, which is comprised of about 98% (by weight) aromatic ester (methyl salicylate).

Suitable fragrance solubilizing agents include a variety of solvents including alcohols such as methyl alcohol, ethyl alcohol, isopropyl alcohol, propyl alcohol and the like; glycol ethers (including methyl, ethyl, propyl, isopropyl, butyl, phenyl, and ethylhexyl ethers) and glycol ether esters of glycols (such as ethylene glycol, diethylene glycol, triethylene glycol, propylene glycol, dipropylene glycol, tripropylene glycol and the like) including diethylene glycol mono butyl ether and diethylene glycol mono butyl ether acetate and mixtures thereof.

As with fragrance materials for use herein, any desirable known preservative may be employed to produce the compositions of this invention provided that the preservative passes standard screening for challenge testing and storage stability and, furthermore, that users/customers would be satisfied with the aesthetics (i.e., color, smell and the like) of cleaning composition containing the preservative. Suitable preservative agents for use in the present invention include a variety of chemical compounds with the ability to impart to chemical formulas a resistance to microbial contamination in order to assure product safety and integrity over the useful life of the product. Such preservative agents include 1,3-dihydroxymethyl-5-5-dimethylhydantoin (DMDM Hydantoin); 1,2-benzisothiazolin-3-one; 5-chloro-2-methyl-4-isothiazolin-3-one; 2-methyl-4-isothiazolin-3-one; 3-iodo-2-propynyl butyl carbamate; phenoxyethanol; 2-bromo-2-nitropropane-1,3-diol; methyl paraben; propyl paraben; isopropyl paraben; butyl paraben; isobutyl paraben; diazolidinyl urea and hydroxymethylglycinate and mixtures thereof.

Generally, in formulating aqueous, surfactant-free cleaning compositions of the present invention, the following ranges of ingredients (as weight percentages per total weight of aqueous cleaning composition) may satisfactorily be used:

Formulation Ranges (as applied to a fiber surface)

| Ingredient | Operating Range | Preferred Range |
|---|---|---|
| dispersing agent | 0.01–10.0% | 0.05–1.0% |
| anti-redeposition agent | 0.001–10.0% | 0.05–1.0% |
| chelating agent | 0.01–5.0% | 0.05–1.0% |
| alkali counter ion | Quantity sufficient to adjust pH to about 5.0–12.0 | Quantity sufficient to adjust pH to about pH 9.0–10.0 |
| fragrance | 0.0001–2.0% | 0.001–0.2% |
| fragrance solubilizing agent | 0.05–25.0% | 0.1–2.0% |
| preservative agent | Quantity as desired | Quantity as desired |
| water | Quantity sufficient to adjust weight percentage to 100% | Quantity sufficient to adjust weight percentage to 100% |

Surfactant-free, aqueous cleaning compositions containing the above tabulated ranges of ingredients may be prepared from preformed concentrated stock solutions. In practice, these concentrated stock solutions are intended to be diluted with water by an end user at the site of application of the cleaning composition to a desired level depending on the particular soil extraction device or technique to be employed by the end user to treat the fiber surface. The concentrated stock solutions contain predetermined quantities (on a weight basis) of the desired ingredients so that upon dilution the resulting aqueous compositions will contain such ingredients in quantities (on a weight percent basis) corresponding to the above tabulated operating and/or preferred ranges of ingredients to be incorporated in the aqueous cleaning compositions. The concentrated stock solutions are normally diluted by a factor of from about 1:2 to about 1:256 to produce the aqueous composition for application to carpets, upholstery and other fiber surfaces. Preferably, the concentrated stock solutions are diluted by a factor of from about 1:4 to about 1:128 and, most preferably, from about 1:16 to about 1:64.

In a preferred embodiment of the present invention, the surfactant-free, aqueous cleaning compositions of this invention contain polymeric dispersing agents, polymeric anti-redeposition agents and a sufficient amount of an alkali counter ion to maintain the pH of the aqueous composition in a range of about 5.0–12.0, most preferably 9.0–10.0. In this regard, it has been found that such compositions have the advantage of demonstrating soil suspending activity without the use of micelle-forming surfactants found in prior art carpet and upholstery cleaning products. This is a significant commercial advantage since products containing the micelle-forming surfactants have received low customer satisfaction ratings due to problems relating to their use (i.e., stains reappearing and degradation of fiber appearance/pile). In the present compositions, the absence of micelle-forming surfactants enhances the method of stain removal; as well as, the subsequent removal of residual cleaner known to have a negative impact on the inherent carpet and upholstery anti-soil properties.

Most preferably, carpet cleaning compositions in accordance with the present invention comprise mixtures of the following ingredients:

a) a water-soluble chelating agent such as water-soluble ethylenediaminetetraacetic acid;

b) a dispersing agents such as water-soluble polyacrylic acids;

c) a anti-redeposition agent such as water-soluble polyvinylpyrrolidone;

d) a sufficient amount of alkali counter ions such as sodium (Na), potassium (K), ammonium hydroxide ($NH_4OH$), isopropylamine and alkanolamines to maintain the pH of the composition in a range of about 5.0 to about 12.0; preferably in a range of about 9.0–10.0; and e) a fragrance compound such as terpenes or terpene derivatives;

f) a fragrance solubilizing agent such as various alcohol or glycol ethers; and g) a preservative such as DMDM Hydantoin.

The polymeric dispersing agents are included in the present surfactant-free cleaning compositions to take advantage of the lower energy of the fiber surface to force the soil off the surface and into the dispersing agent. In this invention it is of less importance to emulsify oil than it is to limit the penetration of dispersed soil into the fiber in order to achieve enhanced soil removal results as compared with prior art surfactant containing cleaning compositions.

Specifically, the aqueous compositions of the present invention are formulated to provide high energy cleaners having surface tensions of greater than about 38 dynes/centimeter (cm) for application onto low energy fiber surfaces (i.e., less than about 35 dynes/cm) thereby establishing an energy barrier which is employed to maintain separation between the surface of the fiber and the surfactant-free cleaning composition. The formation of this energy barrier allows for the efficient transfer of a stain from the surface of a fiber into an aqueous liquid phase and, also, enables the dissolution of charged particles (such as dirt and acid dye), polar soils (such as sugars and starches) and non-polar soils (such as oil) from the surface of the fiber into a solution of the cleaning compositions of this invention.

Thus, the surfactant-free, aqueous cleaning compositions of the present invention containing polymeric dispersing and anti-redeposition agents rely on a basic principle of operation in order to achieve the functional advantages of the present cleaning compositions as compared with prior art cleaning compositions. That is, the energy barrier formed between a fiber surface and the cleaning compositions of this invention prevent redeposition of dirt and dye particles onto a fiber and facilitates quicker adsorption of the solublized soil into a clean cloth used to remove the unwanted soil and reduce the amount of residual cleaning solution left on the fiber after completion of the cleaning task.

It should be noted that the advantages achieved employing the higher surface tension cleaners of the present invention, while being most pronounced on fibers with a soil-repellant finish, are also realized to a lesser degree on non-treated synthetic fibers (i.e., nylon, polyester, polypropylene and acrylic), which are intrinsically low energy surfaces and essentially non-absorbent to water based liquids.

In the process of the present invention, a surfactant-free cleaning composition having a surface tension of at least about 38 dynes per cm (preferably, above 60 dynes per cm) is applied to a soiled or stained fiber surface such as carpets, upholstery and the like in order to prevent the problems which have been encountered with prior art low surface tension cleaning compositions which penetrate the typical topical hydrophobic fluorochemical soil repellant and/or stain resistant finish treatments on the fiber surface. The cleaning composition may be applied to a stained or soiled area employing a hand held sprayer, a pull/push applicator, a woven or non-woven fabric wipe or a similar device as long as a low force is used. Application of the present cleaning compositions under a high force will reduce the effectiveness of the invention due to increased penetration of the solution into the fiber.

Thus, in the processes of the present invention, the cleaning compositions may be used with a hand-held, upright, or commercial type extraction device. Such applications are normally accomplished by incorporating a suitable concentrated version of the cleaning composition into an applicator and diluting the concentrate sufficient to enable the diluted cleaning composition to perform the cleaning function satisfactorily when applied to a fiber surface. In operation, the benefits of a surfactant-free formulation are realized since cleaning compositions that do not penetrate the fiber not only provide better stain and soil cleaning benefits on the fiber surface, but also are more readily extracted by extraction devices.

Functionally, the absence of surfactants in the compositions of the present invention greatly enhances the effectiveness of these cleaning compositions as compared with prior art surfactant containing cleaning compositions since the presence of surfactants in the prior art products reduces the surface tension of the cleaning composition and significantly reduces the dispersing properties of the composition. In this regard, the surfactant-free compositions of the present invention are formulated to exhibit higher surface tension characteristics than prior art cleaning compositions when applied to a fiber surface whereby any soiled or stained areas are contained on the surface and are available for subsequent removal from the surface by known absorption or extraction techniques.

EXAMPLE 1

A 2500 gram (g) sample of a surfactant-free aqueous cleaning composition in accordance with the present invention was prepared by blending, in laboratory scale apparatus, the following ingredients:

| Ingredients | Weight Percent (%) | Grams (g) |
|---|---|---|
| Water (Tap) | 97.9670 | 2449.17 |
| EDTA, Tetrasodium salt | 1.2000 | 30.00 |
| Polyacrylic acid, sodium salt | 0.3800 | 9.50 |
| Polyvinylpyrrolidone | 0.1000 | 2.50 |
| DMDM Hydantoin | 0.0500 | 1.25 |
| Ethyl Alcohol | 0.3000 | 7.50 |
| #181335 Lemon | 0.0030 | 0.08 |
| Totals | 100.0000 | 2500.00 |

The mixing procedure employed in producing the 2500 g sample included initially weighing and incorporating 2449.17 g water into a 5000 mL polypropylene beaker and then placing the beaker containing the water on a steel mixer base, inserting a Talboy agitator into the beaker and initiating agitation. Then, 30.00 g EDTA (tetrasodium salt), 9.50 g polyacrylic acid (sodium salt), 2.50 g polyvinylpyrrolidone and a preservative (DMDM Hydantoin) were incorporated, in listed order, into the water under agitation. The resulting mixture was blended for 5 minutes. Separately, 7.50 g ethyl alcohol and 0.08 g fragrance (#181335 Lemon) were weighed and mixed in a 50 mL Pyrex beaker and this mixture was pre-blended with a spatula in the 50 mL beaker after which the resulting pre-blend was introduced into the original mixture in the 5000 mL polypropylene beaker. The combined mixture was then blended for 10 minutes after which an 8 ounce (oz) portion of the 2500 mL sample mixture was collected and transferred for Quality Control (QC) testing. Other portions of the mixture were collected and introduced into 32 oz. high density polyethylene (HDPE) containers with a suitable closure (28–400 High Flow Pull Push manufactured by Creative Packaging Corp. or a Model 0176 spray/stream/off trigger sprayer manufactured by Owens-Brockway) to be used as Test Samples for the performance testing detailed hereinafter in Examples 2 and 4.

The QC testing of the 8 ounce sample resulted in the following data:

| | Quality Control | |
|---|---|---|
| Property | Predetermined Ranges | Test Results |
| Appearance/Odor | — | Clear liquid; mild citrus odor |
| pH | 9.0–9.5 | 9.24 |
| Sp. Gravity @ 25° C. | 1.015–1.020 | 1.018 |
| 1% Solids | 0.7–0.8 | 0.76 |
| Surface Tension | >60 dynes/cm | 63.4 |

EXAMPLE 2

To simulate use of the surfactant-free aqueous cleaning compositions of the present invention for stain removal on stain-resistant carpeting and to demonstrate the improved stain removal results achieved with the compositions of the present invention as compared with prior art commercial products, Test Samples of the cleaning composition produced in Example 1, packaged in a 32 ounce container with a high flow pull/push applicator, were applied to a variety of laboratory staining agents and were blotted and the resulting stain ratings were compared with the stain rating results achieved employing various commercially available prior art cleaning compositions as Controls under the same test conditions.

For purposes of this comparative test, a series of 1½" stains were applied to a test carpet at 2½" intervals by pipette transfer of approximately 6 mL of various staining agents tabulated below onto the carpet surface. The stains were conditioned for 24 hours at 23° C. (70% relative humidity) and excess stain was scraped from the surface with a scraper.

Then, a 7 g test sample of the cleaning composition produced in Example 1 was applied to each of the stained areas on the carpet surface using a high flow pull/push applicator. For purposes of providing control samples for comparative testing, two additional 7 g samples comprising two commercially available prior art cleaning products (i.e., one sample being prepared with RESOLVE® "Spot and Stain" and the other being prepared with BISSELL "Tough Stain Precleaner"™) were applied to in a similar manner to comparable stained areas on separate carpets. Three minutes after application, all of the stained areas were blotted with no more than two paper towels (as necessary). Then, additional 7 g test samples of each of the cleaning compositions were reapplied to the stained areas and these areas were again blotted until no further transfer of stain from the carpet to the towels was noted (~10 minutes). If necessary, a scraper was employed to agitate any un-dissolved dried particles remaining on the carpets. A final 7 g Test Sample of each of the cleaning composition samples was reapplied to the stained areas and these areas were blotted again until no transfer was noted (~5 minutes). Thereafter, the carpet was conditioned for 24 hours at 23° C. and the following tabulated comparative stain rating results were determined based on visual inspection of the carpet after treatment:

TABLE I

| | Stain Rating Results | | |
|---|---|---|---|
| | CLEANER COMPOSITIONS | | |
| Staining Agents | Test Sample Cleaning Composition From Example 1 | RESOLVE ® "Spot and Stain" (CONTROL) | BISSELL "Tough Stain Precleaner" ™ (CONTROL) |
| Grape Juice ("Welch's 100% Grape Juice") | 5.0 | 4.5 | 4.5 |
| "Kool-Aid" (Cherry Burst; pre-sweetened/pre-mixed) | 4.8 | 3.5 | 3.0 |
| Wine (Mogen David Concord) | 4.8 | 4.5 | 4.5 |
| Mustard (French's) | 3.5 | 3.5 | 3.0 |
| Chocolate Syrup (Hershey's Genuine) | 5.0 | 4.8 | 4.8 |
| Ragu Brand (Meat Sauce) | 4.7 | 4.5 | 4.5 |

Rating Scale: 5—no stain remaining
4—75% of stain removed
3—50% of stain removed
2—25% of stain removed
1—0% of stain removed

EXAMPLE 3

Typically, the surfactants employed in prior art cleaning compositions have been incorporated for purposes of lowering the surface tension of aqueous cleaning solutions when the surfactants are added at concentrations above critical micelle concentrations (CMC) of the surfactants.

In this Example, the surface tension characteristics of various conventional prior art cleaning compositions were measured in comparison with the surface tension exhibited by the cleaning compositions of the present invention. As determined by measurement with a calibrated CSC-DuNoüy Tensiometer (Model 70535; SN 12516), the prior art cleaning compositions have exhibited surface tensions below 35, and typically between 22 and 35, dynes per centimeter (cm) as compared with the cleaning compositions of the present invention which exhibit surface tensions of at least about 38.0 and higher as is demonstrated in the following Table II.

TABLE II

| Surface Tension Measurements | |
|---|---|
| Carpet Cleaning Compositions | Dynes/cm |
| RESOLVE ® "Spot and Stain" | 22.0 |
| BISSELL "Tough Stain Precleaner" ™ | 33.2 |
| Formula 409 ® Carpet Cleaner | 29.5 |
| Stain Control ™ | 30.5 |
| Test Sample from Example 1 | 63.4 |

Since the surface tension of the prior art aqueous surfactant solutions are typically below 35 dynes per cm, it has been found that the standard soil repellent finishes on fiber surfaces such as carpets, upholstery and the like have been unable to prevent surfactant containing cleaning solutions from penetrating the soil repellent finishes applied on carpet surfaces resulting in several problems including the following:

1. as the stain/soil is emulsified and dispersed, instead of being removed, the stain/soil is carried deeper into the fiber, backing and padding of a carpet as the low energy of the fiber finish is overcome. This can actually cause the soil to appear to be removed, only to be discovered that the stain/soil has actually only migrated to the padding and will later often re-migrate back to the surface as the fiber dries (or during subsequent application of cleaner).
2. as the surfactant solution penetrates a carpet fiber, the visual appearance of the fiber is changed due to loss of twist and inflection of the angle of carpet pile. While all of the cleaners tested herein had some effect on the fiber pile, surfactant-containing cleaners caused greater fiber damage. The cleaning compositions of the present invention as produced in accordance with Example 1 caused less initial damage and the fibers had greater ability to recover to near original appearance. The loss of twist is accompanied by an increased loss of fiber, as mechanical force is applied to the carpet to remove stains and soil.
3. once the surfactant solution has penetrated completely into the carpet fiber, backing and padding, the solution is more difficult to remove by either blotting or extraction. This results in longer drying times and decreased customer satisfaction.

Thus, it has been found that the surfactant-free cleaning compositions of the present invention as exemplified by the compositions produced in accordance with the procedures set forth in Example 1 outperformed the prior art surfactant containing cleaning compositions which were tested such as the Control Samples set forth in Example 2. Also, when the stained areas discussed in Example 2 were cut away and inspected, it was noted that a significant portion of many stains in the Control Samples had migrated, spreading the stains out from the center to the, base of the fiber strands and carpet backing.

EXAMPLE 4

This Example is intended to demonstrate the use of the surfactant-free aqueous cleaning compositions of the present invention to clean carpeting and to illustrate the enhanced affect the use of these compositions has on the attraction of common dirt to a cleaned area of carpet fiber (i.e., to prevent re-soiling). Re-soiling performance of the compositions of this invention has been determined herein by application of the cleaning composition of Example 1 to test carpet and subsequent application of test soil, followed by vacuuming.

The re-soil testing procedure employed in this Example 4 included adjusting the nozzle of a spray/steam/off trigger sprayer to a medium spray pattern (typically about 70% closed for an adjustable sprayer that can be adjusted anywhere from a fine mist through medium, coarse and, finally, to a stream spray pattern when fully opened). Then, 15 grams of each test carpet cleaning composition was sprayed onto an approximately 3"×15" area of carpet (at an application rate of 0.3 grams per inch). After 3 minutes, the treated area was thoroughly blotted with paper towels (using one paper towel per 5 grams of cleaning composition applied). The carpet sample was then conditioned for 24 hours at 23° C. (~70% relative humidity). Thereafter, a ⅛" layer of Scotts Potting Soil was applied evenly to the carpet sample and excess soil was shaken from the carpet. The results of this soil application to the previously cleaned carpet were observed and recorded employing the rating scale set forth below and then one-half of the re-soiled carpet was vacuumed by passing the a vacuum cleaner over the carpet surface three times and the vacuumed area of the re-soiled carpet was observed and graded utilizing the same rating scale set forth below. The results of this re-soil testing were as follows:

TABLE III

| Re-soiling Results | | | |
|---|---|---|---|
| | CLEANERS | | |
| | Test Sample Cleaning Composition From Example 1 | RESOLVE ® "Spot and Stain" (CONTROL) | BISSELL "Tough Stain Precleaner" ™ (CONTROL) |
| Without Vacuuming | 1.0 | 0.5 | 1.0 |
| With Vacuuming | 4.0 | 3.5 | 3.0 |

Re-soil Rating: 5—no soil remaining
4—slight soil remaining
3—noticeable soil remaining
2—considerable soil remaining
1—severe soil remaining Based on visual observation and ratings of the re-soil testing, it was determined that the surfactant-free aqueous cleaning compositions of the present invention outperformed the commercially available prior art Control products. Also, when the soiled areas were closely inspected, it was noted that a significant level of imbedded soil was left under the surface of the carpet fiber when the Control products were applied to the carpet surface. It is believed that this imbedded soil resulted from the presence of surfactants in the Control products, thus having an adverse influence on the re-soil rating as compared with the surfactant-free cleaning compositions of the present invention which did not leave such imbedded soil under the surface of in the carpet fiber.

EXAMPLE 5

To simulate the use of the surfactant-free aqueous cleaning compositions of the present invention to disperse common dirt and to demonstrate the improved dispersion achieved with the compositions of the present invention as compared with prior art commercial products, a 20 g test sample of the aqueous cleaning composition produced in Example 1 was introduced into a 24 mL KIMAX Sample Vial (VWR Cat #66010-429)along with a dirt sample comprising 0.2 g Georgia Red Clay which was obtained from a household yard and was prepared by air drying at 23° C. and 70% relative humidity and, then, grinding with a mortar and pestle. For purposes of providing control samples for comparative testing, two additional 20 g samples comprising two commercially available prior art cleaning products (i.e., one sample being prepared with RESOLVE® "Spot and Stain" and the other being prepared with BISSELL "Tough Stain Precleaner"™) were mixed with dirt samples in a similar manner in separate Sample Vials.

After the test sample and the control sample cleaning solutions and the dirt sample were introduced into the Sample Vials, the Sample Vials were each capped and held without shaking for 15 seconds. Then, each of the Sample Vials was inverted three times, followed by a 60 second holding period without shaking and then each of the Sample Vials was again inverted three times. Based on visual observations, the dispersion rate of the dirt in each of the tested cleaning solutions was determined and recorded after a 1 minute, a 15 minutes and a 60 minutes interval and is tabulated as follows:

Soil Dispersion Results

| | CLEANERS | | |
|---|---|---|---|
| Time | Claim 1 Cleaner G-147E-010821-429 | RESOLVE ® Spot and Stain | BISSELL Tough Stain Precleaner ™ |
| 1 Minute | 3.0 | 0.5 | 0.1 |
| 15 Minutes | 3.0 | 0.5 | 0.1 |
| 60 Minutes | 3.0 | 0.5 | 0.1 |

Soil Dispersion Rating: 5—100% dispersed
4—75% dispersed
3—50% dispersed
2—25% dispersed
1—10% dispersed
0—0% dispersed As a result of the visual observation and ratings of this red clay dispersion testing, it was demonstrated that the cleaning compositions of the present invention significantly outperformed both of the commercially available, prior art control products tested in regard to dispersion properties—without the use of surfactants.

While the present invention has been described with reference to specific embodiments, examples and ranges, it will be clear to those skilled in the art that modification may be made without departing from the invention which is specifically set forth in the following claims.

What is claimed is:

1. A process for cleaning a fiber surface, comprising,
applying to a stained or soiled area on the fiber surface an effective amount of an aqueous, surfactant-free cleaning composition having a surface tension of at least greater than 38 dynes per centimeter and comprising
a) a water-soluble polymeric dispersing agent;
b) a water-soluble polymeric and-redeposition agent;
c) a counter ion;
d) a chelating agent;
e) a fragrance material;
f) a fragrance solubilizing agent; and
g) a preservative agent.

2. The process of claim 1, wherein the dispersing agent is polyacrylic acid; polyacrylic acid/maleic acid copolymers; polymethacrylic acid, polyaspartic acid or mixtures thereof.

3. The process of claim 1, wherein the anti-redeposition agent is polyvinylpyrrolidone; polyvinylbetaine; polyvinyl pyrrolidone/vinylacetate copolymers; polyvinylpyrrolidone/dimethylaminoethylmethacrylate copolymers; polyvinylpyrrolidone/acrylic acid copolymers; polymethylvinylether/maleic anhydride copolymers; polyvinylpyridine-n-oxide or mixtures thereof.

4. The process of claim 1, wherein the counter ion is the counter ion of sodium ions, potassium ions, calcium ions, magnesium ions, ammonium ions, amine ions or mixtures thereof.

5. The process of claim 1, wherein the chelating agent is ethylenediaminetetraacetic acid; diethylenediaminepentaacetic acid; nitrilotriacetic acid; hydroxyethylenediaminetriacetic acid; immunosuccinic acid; aminotrismethylenephosphonic acid; hexamethylenediaminetetramethylenephosphonic acid; diethylenetriaminepentamethylene-phosphonic acid or mixtures thereof.

6. The process of claim 1, wherein the fragrance material is terpenes, oxygenated terpene derivatives, oxygenated aromatic derivatives or mixtures thereof.

7. The process of claim 1, wherein the fragrance solubilizing agent is alcohols, glycol ethers or glycol ether esters.

8. The process of claim 1, wherein the amount of counter ion present in the cleaning composition is sufficient to maintain a pH range of about 5.0 to about 12.0 in the aqueous composition.

9. The process of claim 1, wherein the preservative agent is 1,3-dihydroxymethyl-5-5-dimethylhydantoin (DMDM Hydantoin); 1,2-benzisothiazolin-3-one; 5-chloro-2-methyl-4-isothiazolin-3-one; 2-methyl-4-isothiazolin-3-one; 3-iodo-2-propynyl butyl carbamate; phenoxyethanol; 2-bromo-2-nitropropane-1,3-diol; methyl paraben; propyl paraben; isopropyl paraben; butyl paraben; isobutyl paraben; diazolidinyl urea hydroxymethylglycinate or mixtures thereof.

10. A method for cleaning a fiber surface, comprising,
applying to a stained or soiled area on the fiber surface an effective amount of an aqueous, surfactant-tree cleaning composition comprising
a) a water-soluble polymeric dispersing agent;
b) a water-soluble polymeric anti-redeposition agent;
c) a counter ion;
d) a chelating agent;
e) a fragrance material;
f) a fragrance solubilizing agent; and
g) a preservative agent.

11. The method process of claim 10, wherein the anti-redeposicion agent is polyvinylpyrrolidone; polyvinylbetaine; polyvinyl pyrrolidone/vinylacetate copolymers; polyvinylpyrrolidone/dimethylaminoethylmethacrylate copolymers; polyvinylpyrrolidone/acrylic acid copolymers; polymethylvinylether/maleic anhydride copolymers; polyvinylpyridine-n-oxide or mixtures thereof.

12. The method of claim 10, wherein the counter ion is the counter ion of sodium ions, potassium ions, calcium ions, magnesium ions, ammonium ions, amine ions or mixtures thereof.

13. The method of claim 10, wherein the chelating agent is ethylenediaminetetraacetic acid; diethylenediaminepentaacetic acid; nitrilotriacetic acid; hydroxyethylenediaminetriacetic acid; immunosuccinic acid; aminotrismethylene-phosphonic acid; hexamethylenediaminetetramethylenephosphonic acid; diethylenetriaminepentamethylene-phosphonic acid or mixtures thereof.

14. The method of claim 10, wherein the fragrance material is terpenes, oxygenated terpene derivatives, oxygenated aromatic derivatives or mixtures thereof.

15. The method of claim 10, wherein the fragrance solubilizing agent is alcohols, glycol ethers or glycol ether esters.

16. The method of claim 10, wherein the amount of counter ion present in the cleaning composition is sufficient to maintain a pH range of about 5.0 to about 12.0 in the aqueous composition.

17. The method of claim 10, wherein the preservative agent is 1,3-dihydroxymethyl-5-5-dimethylhydantoin (DMDM Hydantoin); 1,2-benzisothiazolin-3-one; 5-chloro-2-methyl-4-isothiazolin-3-one; 2-methyl-4-isothiazolin-3-one; 3-iodo-2-propynyl butyl carbamate; phenoxyethanol; 2-bromo-2-nitropropane-1,3-diol; methyl paraben; propyl paraben; isopropyl paraben; butyl paraben; isobutyl paraben; diazolidinyl urea hydroxymethylglycinate or mixtures thereof.

* * * * *

UNITED STATES PATENT AND TRADEMARK OFFICE

CERTIFICATE OF CORRECTION

PATENT NO. : 7,005,013 B2
APPLICATION NO. : 11/011512
DATED : February 28, 2006
INVENTOR(S) : Hammock It is certified that error appears in the above-identified patent and that said Letters Patent is hereby corrected as shown below:

Column 3, line 11: replace “iminodisuccinate” with --iminodisuccinic--.
Column 11, line 64: replace “and” with --anti--.
Column 12, line 20 and column 13, line 1: replace “immunosuccinic” with --iminodisuccinic--.
Column 12, line 41 and column 14, line 10: insert --,-- following the word urea.

Signed and Sealed this

Twenty-fifth Day of July, 2006

JON W. DUDAS
*Director of the United States Patent and Trademark Office*